US005503581A

United States Patent [19]

McCullough

[11] Patent Number: 5,503,581

[45] Date of Patent: Apr. 2, 1996

[54] APPARATUS FOR ADJUSTABLE FIN AND FIN BLOCK

[76] Inventor: Robert P. McCullough, 2517 Jones Ave., Renton, Wash. 98056

[21] Appl. No.: 368,596

[22] Filed: Jan. 4, 1995

[51] Int. Cl.[6] ..... B63B 1/00

[52] U.S. Cl. ..... 441/79; 441/68; 114/130; 114/141

[58] Field of Search ..... 441/68, 79, 74; 114/138, 140, 141, 130, 39.2

[56] References Cited

U.S. PATENT DOCUMENTS

| | | | |
|---|---|---|---|
| 3,950,807 | 4/1976 | Sharpe | 9/310 A |
| 4,439,166 | 3/1984 | Maxwell | 441/79 |
| 5,299,963 | 4/1994 | Isensee | 441/79 |

*Primary Examiner*—Edwin L. Swinehart
*Attorney, Agent, or Firm*—Paul L. Griffiths

[57] ABSTRACT

A water ski adjustable fin block and fin are disclosed. The fin block employs a slidable wedge for clamping the fin in place within the fin block during use and allowing the fin to be unclamped just enough to allow adjustment of the fin. A screw arrangement is used to move the wedge. The adjusters allow the leading edge and trailing edge of the fin to be adjusted as to vertical relationship with the water ski. A third adjuster allows the fin to be move longitudinally toward the front or back of the ski. The adjusters provide captive treatment of the fin preventing the fin from excessive movement, or even falling out, while adjustment is performed. The present invention allows a water skier to easily adjust the fin using an allen key or the like.

6 Claims, 4 Drawing Sheets

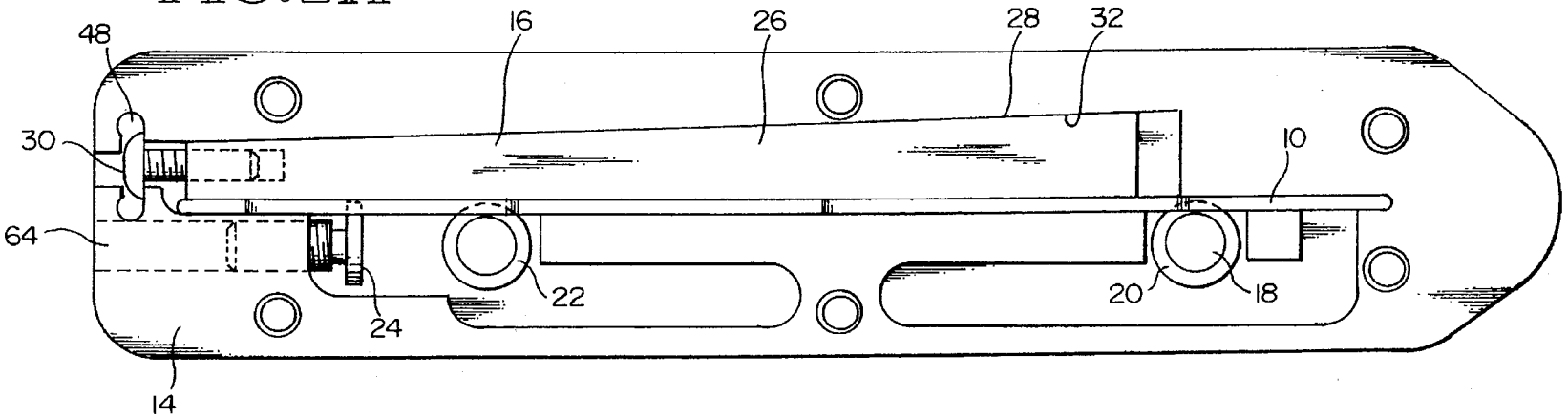
FIG. 2A
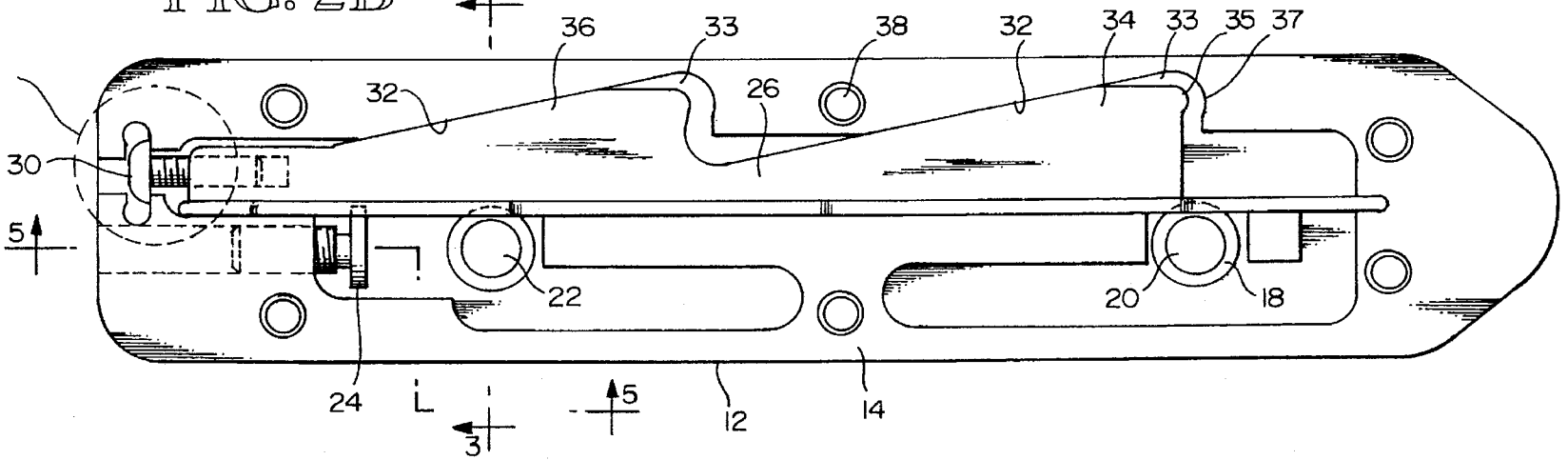
FIG. 2B
FIG. 4

APPARATUS FOR ADJUSTABLE FIN AND FIN BLOCK

TECHNICAL FIELD

The present invention relates to water ski fins and fin blocks, and more particularly, to an adjustable water ski fin block.

BACKGROUND ART

It is well known in the art to use a fin located on the bottom of a water ski to help stabilize the ski, especially in turns. Since individual needs vary, it is desirable to have an easily adjustable fin to overcome differences in speed, water conditions, and course requirements. Present fin systems do not allow for the precise movement of a fin in relation to the water ski. It is beneficial to be able to make small adjustments for fine tuning the fin's position to a skier's preference and have the fin remain attached to the ski and firmly lock the fin in place after adjustment. Present systems employ a friction system using bolts to squeeze the fin block toward the fin. In order to adjust the fin's position, the bolts must be loosened, hence the fin can come completely out of the fin block. Present fins may have indicia on the side thereof in order to help with adjustments, but are difficult to see and must be used with the curved edge of the slot in the water ski where the fin protrudes through the bottom of the ski.

SUMMARY OF THE INVENTION

The present invention is characterized by a water ski fin block having wedge shaped means for locking a water ski fin in place within the fin block. The fin block further includes an adjustment means for moving a water ski fin in a forward direction, a rearward direction, and move the front of the fin into and out of the water ski, exposing more or less of the fin, and moving the rear of the fin into and out of the water ski. The means for moving the fin includes a adjusters that captively hold the fin into the fin block, this also allows for more accurate adjustment of the fin in relation to the fin block and water ski.

BRIEF DESCRIPTION OF THE DRAWINGS

In the drawings, like reference numerals and numbers refer to like parts throughout the various views, and wherein:

FIG. 2A is a bottom view of an embodiment of the present invention showing adjustment members and locking wedge;

FIG. 2B is a view like FIG. 2A, showing an alternative embodiment of locking wedge;

BEST MODE FOR CARRYING OUT THE INVENTION

Figure 1:
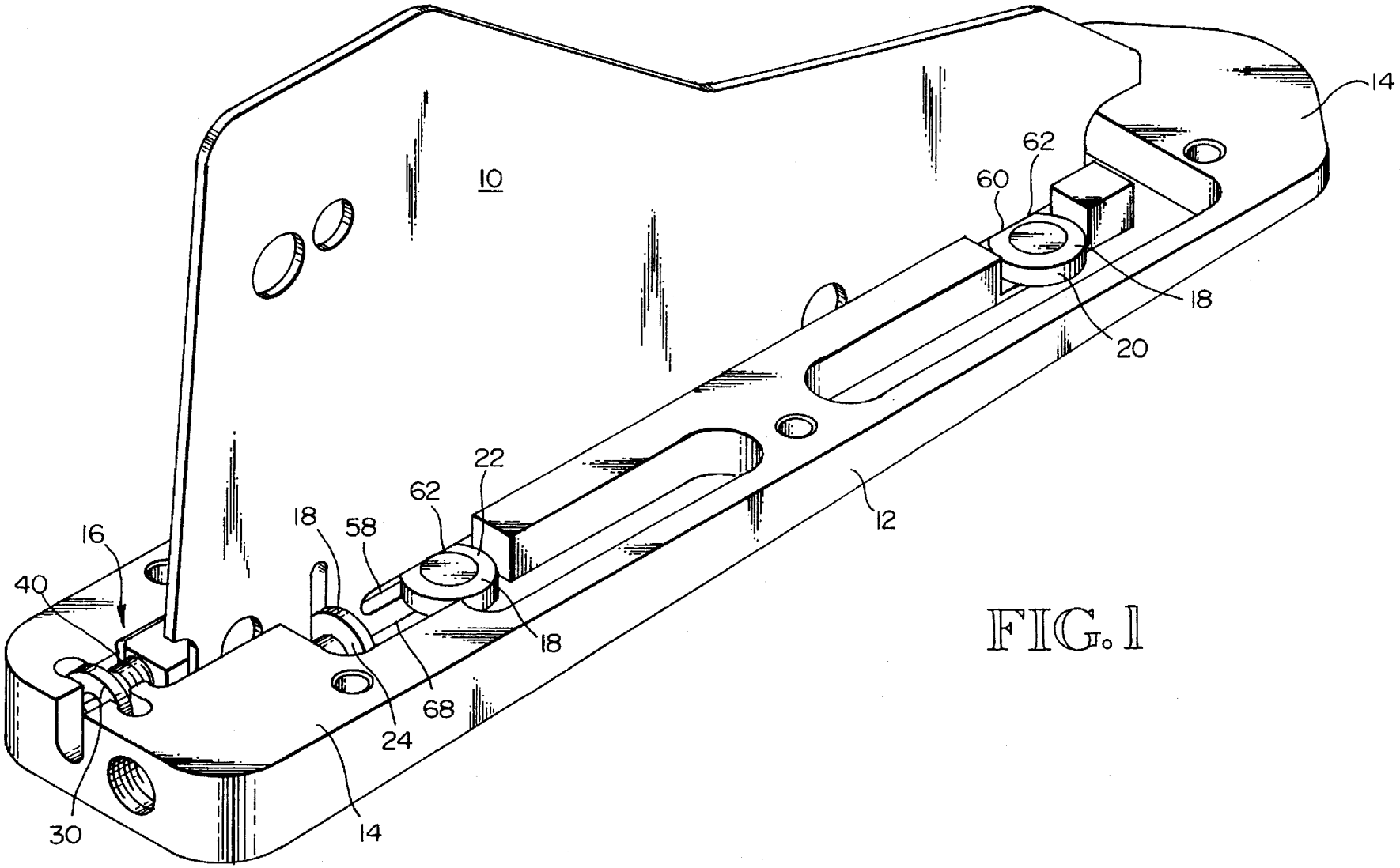
FIG. 1 is a isometric view of a first embodiment of the present invention showing the underside of a fin block and a fin without a water ski in place.

Referring now to FIG. 1, an adjustable water ski fin 10 and fin block 12 are shown. Fin block 12 includes a mounting surface 14 that mounts onto the top surface of a water ski. Water ski fin 10 extends through a slot in the water ski and protrudes out of the bottom of the ski. A fin locking device 16, and further described below, releasably holds fin 10 in place while in use. There are three adjustment screws 18, a perpendicular leading edge adjuster 20, a perpendicular trailing edge adjuster 22, and a lateral adjuster 24. Locking device 16 will now be described.

Referring now to FIG. 2A, a first embodiment of locking device 16 is shown. A single wedge 26 is positioned between an angled surface 28 formed in fin block 12 and water ski fin 10. Fin locking/unlocking screw 30 is used to move wedge 26 from it's engaged position to a disengaged position. When screw 30 is turned clockwise, wedge 26 is pulled toward screw 30 and move laterally toward fin 10 due to angle surface 28 and wedge angled surface 32. Both angled surfaces, 28, 32, preferably form a five degree angle to fin 10. The five degree angle provides a clamping ratio of 0.085–1.0, which securely holds fin 10 in place during use. Due to the angled surfaces 28, 32, very little longitudinal movement is needed to enable adjusters 18 to move fin 10.

Referring now to FIG. 2B, a second embodiment of locking system 16 is shown. Wedge 26 is divided into a first wedge 34 and a second wedge 36. By splitting up the angled surface, an angle of seven degrees is possible, providing a clamping ratio of 0.199–1.0 increasing the clamping force. The double wedge arrangement also requires less longitudinal movement to lock and unlock fin 10. One other advantage to this embodiment is that there is space available for mounting hole 38, providing a more rigid mounting of fin block 12 to a water ski. A chamber 33 is provided at top of each wedge surface 32 to provide a place for sand, dirt or the like to collect and prevent the same from interfering with operation thereof Radius edges 35 and 37 are formed such that when wedge member 26 is moved forward that is also moved laterally away from fin 10.

Figure 4:
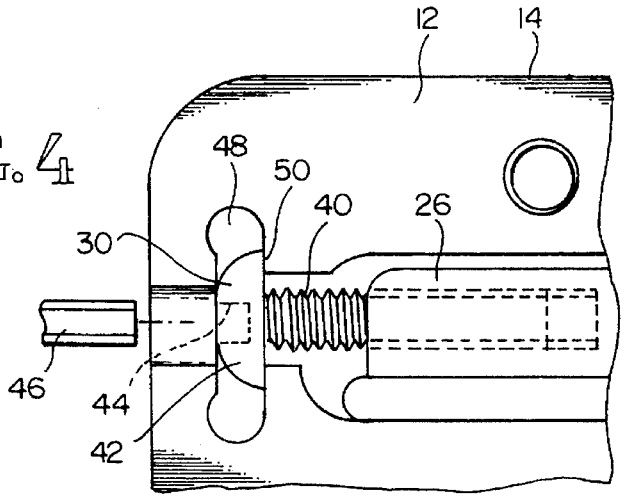
FIG. 4 is an enlarged view of the area indicated in FIG. 2B, showing a portion of a locking wedge lock/unlock screw with portions shown in phantom.

Referring now to FIG. 4, fin locking/unlocking screw 30 includes a threaded portion 40 and a head 42. Screw head 42 includes a means for turning it, e.g., a hex shaped socket 44 into which an allen key 46 can be engaged. Screw head 42 is positioned within a slot 48 formed in fin block 12, and when turned applies pressure to shoulder 50. Threaded portion 40 engages threads in wedge 26 thereby pulling wedge 26 toward screw head 30. An access hole 52 is formed in fin block 12 allowing easy access to socket 44.

Figure 3:
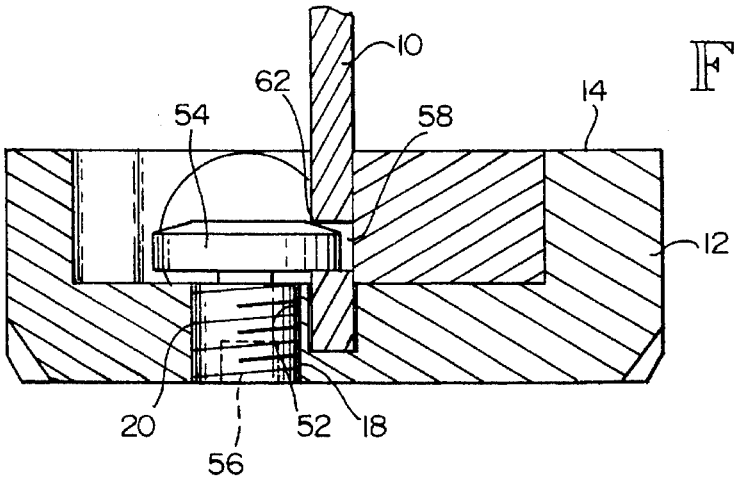
FIG. 3 is an enlarged cross-sectional view, taken substantially along lines 3—3 in FIG. 2B, showing an adjustment member in relation to a fin slot.

Referring to FIG. 3 adjuster 22 is shown, although all adjusters 18 are the same, includes a threaded shaft 52, a double frustoconical head 54 and a means for turning 56. Threaded shaft engages like threads formed in fin block 12. Means for turning 56 may be a hex socket or the like for receiving an allen wrench. When adjuster 18 is turned either clockwise or counterclockwise, head 54 is raised or lowered respectively. Head 54 of trailing edge vertical adjuster engages trailing edge vertical adjuster slot 58. Leading edge vertical adjuster slot 60 is shown in FIG. 1. Since adjuster head 54 and 20 engage slots 58 and 60 respectively, fin 10 is captively held within fin block 12 unless wedge 26 is sized to allow sufficient lateral movement allowing fin 10 to be removed. Even when wedge 26 is sized to allow fin 10 to be removed, it must be adjusted to a fully unlocked position before fin 10 can be so removed.

The tappers on head 54 forming the double frustoconical shape allow fin 10 to have leading edge adjuster 20 in a fully extended position with trailing edge adjuster 22 in a fully retracted position, and vice-versa. Hence, only an edge portion 62 of slots 58 and 60 engages head 54. The tappers are preferably seven degrees, although a greater or lesser angle could be used. Slots 58 and 60 could alternatively be tapered.

Figure 5:
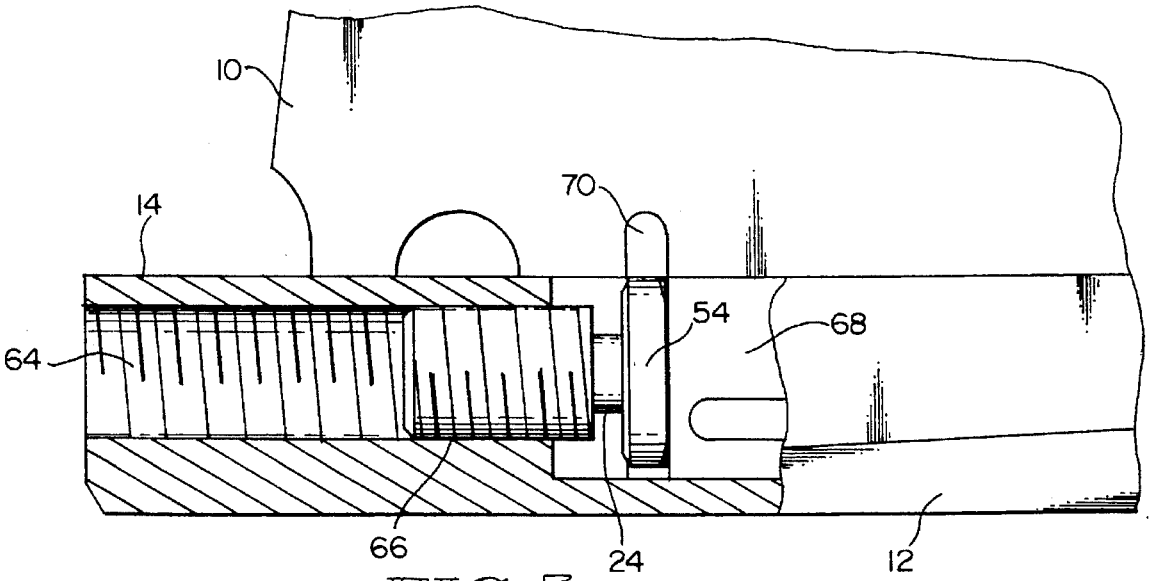
FIG. 5 is an enlarged partial sectional view taken substantially along lines 5—5 in FIG. 2B showing a lateral fin positioning adjustment member.

As shown in FIG. 5, longitudinal adjuster 24 is similar to adjusters 20 and 22 in construction. Threaded hole 64 provides access to turn adjuster 24 in a similar manner as described above. Adjuster 24 has a threaded portion 66 that is two to three times as long as the other adjusters 20, 22. An enlarged slot 68 is formed in fin block 12 to allow adjuster 24 full longitudinal movement and to be removed. A vertical slot 70 in fin 10 engages head 54 of adjuster 24 and provides for longitudinal adjustment of fin 10.

Figure 6:
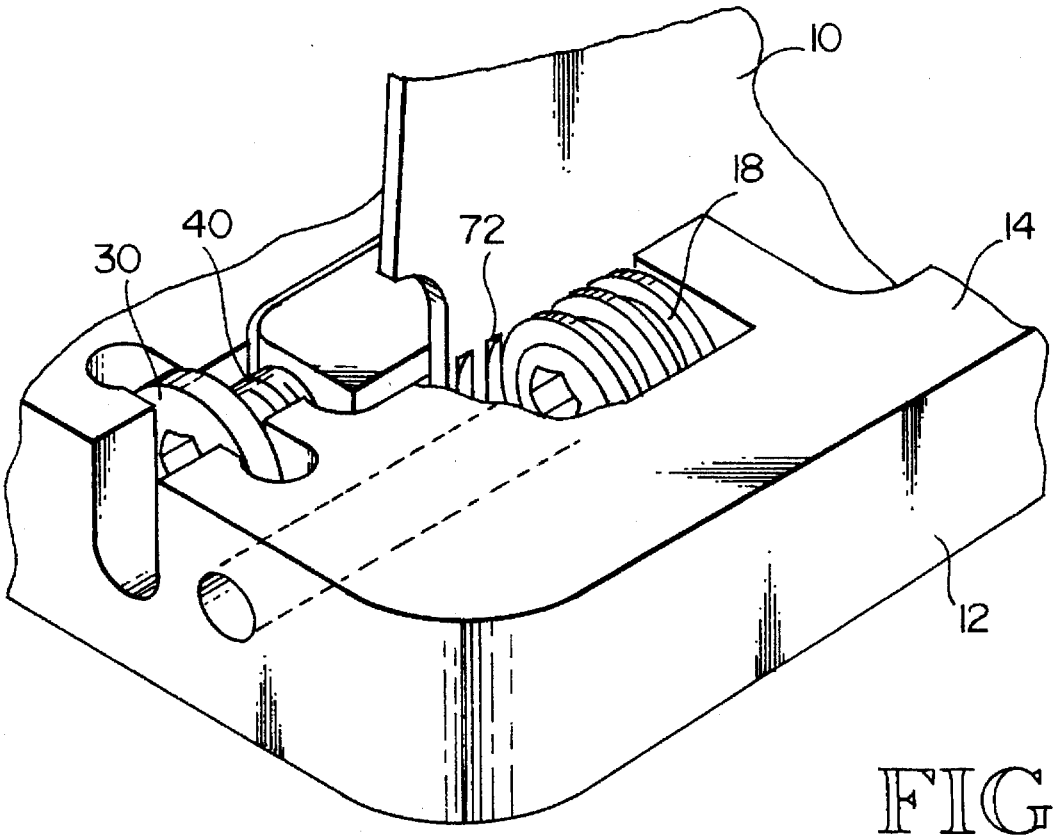
FIG. 6 is an isometric view of a portion of a fin block and fin showing an alternative lateral positioning adjustment means.

Referring to FIG. 6, an alternative embodiment is shown for adjusters 18. Adjuster 18 is a threaded barrel held in place by fin block 12 and the top surface of a water ski. Shallow notches 72 are formed in fin 10. Notches 72 receive portions of threaded barrel 18 such that as barrel 18 is rotated that fin 10 moves, in a similar manner as a radiator clamp. This embodiment also provides a system that holds fin 10 within fin block 12 during adjustment.

The present invention has been described with reference to the preferred embodiments. Modifications and alterations may become apparent to one skilled in the art upon reading and understanding this specification. It is intended to include all such modifications and alterations within the scope of the appended claims and under interpretations of the doctrine of equivalents.

I claim:

1. A water ski fine block and fin comprising:

means for attaching said fin block to a water ski, means for clamping said fin to said fin block while in use and unclamping said fin from said fin block while adjusting the position of said fin to said fin block, and a means for moving said fin, said means for moving said fin captively holding said fin within said fin block while adjustment is being performed, wherein said means for moving said fin includes at least one threaded adjuster acting to move said fin.

2. A water ski fin block and fin comprising:

means for attaching said fin block to a water ski, a wedge block having a fin engaging surface and a fin block engaging surface, said wedge block having a converging side surface and said fin block having a surface converging toward a side surface of said fin, said wedge block converging surface and said fin block converging surface acting in unison to clamp said fin when said wedge block is urged in an appropriate direction generally parallel to said fin by a means for moving said wedge block.

3. The apparatus of claim 2, wherein said wedge block includes two or more converging surfaces on a side opposite said fin engaging surface.

4. The apparatus of claim 2, wherein said means for moving said wedge block includes a threaded opening at one of its ends, a threaded member having a head portion that acts against a portion of said fin block and meshes with said threaded opening such that when the threaded member is turned in one direction the wedge block is moved into a fin locking position and when it is turned in an opposite direction the wedge block is moved into a non-locking position.

5. The apparatus of claim 2, further including at least one adjustment member, said adjustment member having a threaded portion and a head portion, said head portion having at least one radially tapered surface such that the head portion's outer peripheral edge is thinner than a central portion of said head, and an indentation in an end opposite said head portion for receiving a tool for use in turning the adjustment member, a threaded hole in said fin block for receiving said adjustment member, said hole having its normal axis generally parallel to a large flat side of said fin; and a slot in said fin positioned to engage said adjustment member, said slot being located adjacent to an edge portion of said fin, whereby when the adjustment member is turned the head portion within the slot acts to positively move the fin in either of two directions while simultaneously preventing the fin from moving in another direction.

6. A water ski fin block and fin comprising:

a means for attaching said fin block to a water ski, at least one adjustment member, said adjustment member having a threaded portion and a head portion, said head portion having at least one radially tapered surface such that the head portion's outer peripheral edge is thinner than a central portion of said head, and an indentation in an end opposite said head portion for receiving a tool for use in turning the adjustment member, a threaded hole in said fin block for receiving said adjustment member, said hole having its normal axis generally parallel to a large flat side of said fin; and a slot in said fin positioned to engage said adjustment member, said slot being located adjacent to an edge portion of said fin, whereby when the adjustment member is turned the head portion within the slot acts to positively move the fin in either of two directions while simultaneously preventing the fin from moving in another direction.

* * * * *